United States Patent [19]

Browning

[11] Patent Number: 4,593,856

[45] Date of Patent: Jun. 10, 1986

[54] METHOD AND APPARATUS FOR HIGH VELOCITY FLAME SPRAYING OF ASYMMETRICALLY FED WIRE RODS

[76] Inventor: James A. Browning, P.O. Box 6, Hanover, N.H. 03755

[21] Appl. No.: 596,791

[22] Filed: Apr. 4, 1984

[51] Int. Cl.[4] ..... B05B 1/24

[52] U.S. Cl. ..... 239/83; 427/423

[58] Field of Search ..... 239/83, 84, 79, 80, 239/81; 219/74, 76.14, 76.16, 121 PL; 427/422, 423

[56] References Cited

U.S. PATENT DOCUMENTS

| | | | |
|---|---|---|---|
| 2,207,765 | 7/1940 | Stevens | 239/83 |
| 2,920,001 | 1/1960 | Smith et al. | 239/83 X |
| 3,312,566 | 4/1967 | Winzeler et al. . | |

FOREIGN PATENT DOCUMENTS

| | | | |
|---|---|---|---|
| 0049915 | 4/1982 | European Pat. Off. | 239/79 |
| 1064431 | 5/1954 | France | 239/79 |

*Primary Examiner*—Joseph F. Peters, Jr.
*Assistant Examiner*—Daniel R. Edelbrock
*Attorney, Agent, or Firm*—Sughrue, Mion, Zinn, Macpeak and Seas

[57] ABSTRACT

An internal burner or equivalent device for discharging the hot products of combustion as an axial flame from the discharge end of a venturi type nozzle has a flexible or relatively inflexible wire rod presented to the combustion product stream in the vicinity of the flame jet immediately beyond the exit of the nozzle at an angle less than a critical angle such that the wire is melted and atomized as though the wire has been fed axially into and along the flame jet axis. With a flexible wire rod, the impingement by the flame spray causes the wire rod to curve so that the tip of the wire is axially aligned with the flame jet axis. Where the wire rod is rigid, the intersection of the wire rod and the flame jet at an angle less than the critical angle causes melting and uniform breaking away of the melted particles of the wire rod as very fine droplets uniformly distributed within the flame jet gas flow.

3 Claims, 4 Drawing Figures

FIG. 1
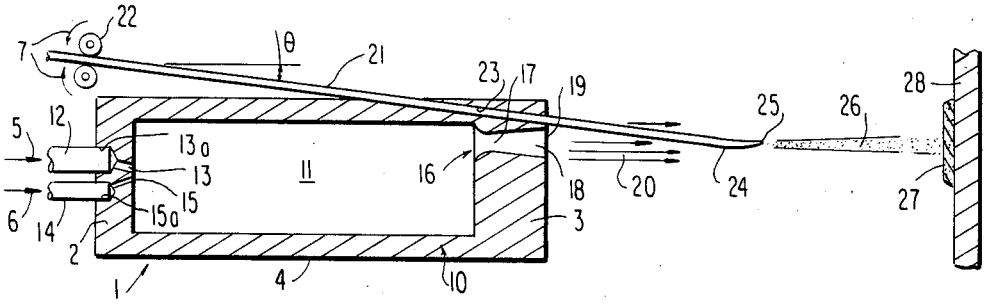
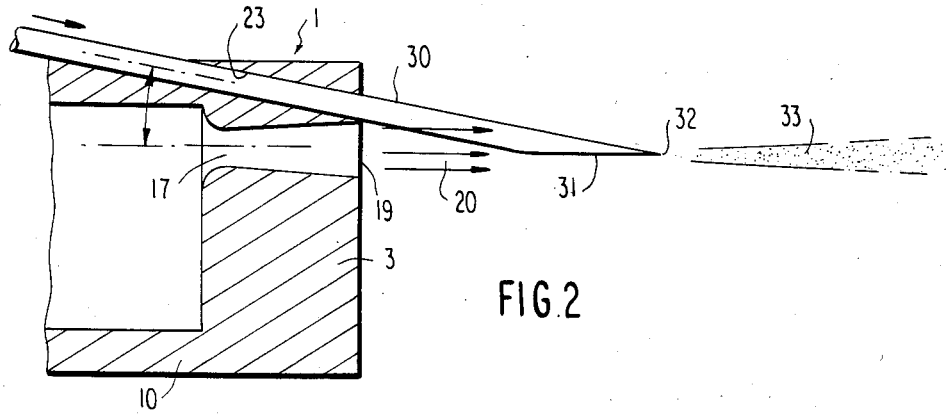
FIG. 2
FIG. 3a
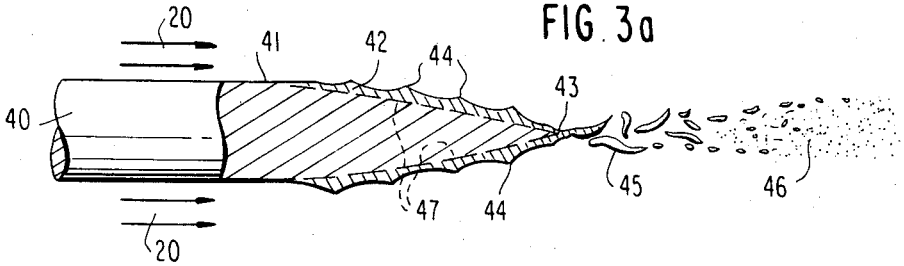
FIG. 3b
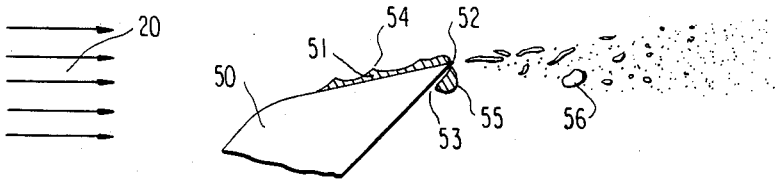

METHOD AND APPARATUS FOR HIGH VELOCITY FLAME SPRAYING OF ASYMMETRICALLY FED WIRE RODS

BACKGROUND OF THE INVENTION

Highly concentrated supersonic liquified material flame spray apparatus has been developed within recent years utilizing an internal burner as the source of the jetlike flame. Such internal burner type devices for the flame spraying of powdered material are in common commercial use, as evidenced by detonation gun type apparatus as well as the ultra-high velocity flame spray apparatus evidenced by my U.S. Pat. No. 4,416,421. In that patent, in particular, powdered material or a solid wire is are fed into the nozzle inlet of a venturi type nozzle remote from the combustion chamber of the internal burner itself or at a point just ahead of the throat of the nozzle bore to insure a concentrated and highly focussed core of spray material passing down a relatively long nozzle flow path downstream of the throat exit from the nozzle and material spray coating on a substrate downstream of the nozzle exit end. When using a material source taking the form of wire rods, in practice, difficulties arise in the feeding of the wire. In a system, for instance, evidenced by FIG. 4 of U.S. Pat. No. 4,416,421, the wire is heated, atomized and the liquid spray droplets as a result of atomization are carried at the core of the gas stream for deposition on the substrate downstream from the exit end of the nozzle. Under optimum operating conditions, excellent coatings at high deposition rates are produced. One of the major difficulties encountered includes the straightness of the wire being fed. As an example, a commonly used nozzle such as nozzle 42 of FIG. 4 has a diameter of only five-sixteenths of an inch and a length of six inches. In practice, it is difficult to find a wire straightener capable of straightening coiled wire sufficiently to permit its use with a nozzle having these dimensions. In addition, the disadvantage exists that it is possible to plug the nozzle when the wire motion stops, preventing further feed of the wire.

It is therefore a primary object of the present invention to provide a method for introducing wire rod material into a supersonic flame jet, particularly useful in internal burner type of flame spraying apparatus in which the wire rod being fed may curl or have a tendency to curl without interfering with the feeding of the wire, and wherein it is virtually impossible to plug the nozzle when wire motion stops.

SUMMARY OF THE INVENTION

The invention is directed in part to a flame spray method comprising the steps of continuously combusting under pressure a contiuous flow of an oxy-fuel mixture confined within an essentially closed internal burner combustion chamber; discharging the hot combustion product gases from the combustion chamber through a flow expansion nozzle as a high velocity hot gas stream; feeding material to the stream for such high temperature heat softening or liquefaction; and spraying at high velocity onto a surface positioned in the path of the stream at the discharge end of the nozzle. The improvement resides in the step of feeding the material by introducing the material as a wire rod outside of said combustion chamber asymmetrically and continuously into the flame jet at an angle to the flame jet and at a point downstream or adjacent to the exit from the burner expansion nozzle such that a liquid film develops about the periphery of the wire rod within the flame jet as a full symmetric circumferential coating about the unmelted portion of the wire or rod within the flame jet. Where the wire rod is flexible, its tip bends within the flame jet so as to be axially aligned therewith. Where the wire rod is generally inflexible, the angle is critical and is limited to the point where the liquid film developed by melting the portion of the wire rod within the flame jet flows towards jet. The asymmetric introduction angle is preferably less than 25 degrees. Where the wire rod is relatively inflexible, it may be preheated prior to its asymmetric introduction into the high velocity flame jet so as to produce a lower bending strength within the wire rod and to insure bending of the wire rod tip to conform to the flow axis of the flame jet.

BRIEF DESCRIPTION OF THE DRAWINGS

FIG. 1 is a vertical sectional view of an internal burner type high velocity flame spraying apparatus utilizing an asymmetrical wire rod feeding arrangement forming a preferred embodiment of the present invention, wherein the wire rod being fed is relatively flexible.

FIG. 2 is an enlarged, sectional view of a portion of the apparatus of FIG. 1 feeding a relatively rigid wire rod.

FIG. 3*a* is a longitudinal view, partially in section of the tip of the wire in the embodiment of FIG. 1 under optimum atomization conditions.

FIG. 3*b* shows the tip of a wire under adverse wire atomization where the angle of asymmetrical feed of the wire to the flame jet is in excess of the critical angle.

DESCRIPTION OF THE PREFERRED EMBODIMENT

FIGS. 1 and 2 depict an internal burner type flame spray apparatus, indicated generally at 1, comprised principally of the internal burner 10 which is of elongated cylindrical form including axially opposed end walls 2 and 3 at the inlet and outlet ends, respectively, and being integrally joined by way of a cylindrical sidewall 4. The inlet end wall 2 is provided with a gas injection passage or bore 13 and a fuel injector passage or bore 15. Bore 13 is enlarged as at 13*a* to sealably receive the end of an oxygen delivery tube 12 through which oxygen flows continuously under pressure as indicated by arrow 5. Bore 15 is enlarged as at 15*a* to sealably receive the end of a fuel supply tube 14 receiving fuel continuously under pressure from a source (not shown) as indicated by arrow 6. The fuel passes through the injector passage 15 into the combustion chamber 11 at the upstream end thereof and mixes with the supply of oxygen which enters the combustion chamber through passage 13. Ignition may occur as a result of a spark being produced by a spark gap adjacent to bores 13 and 15 within the combustion chamber 11 (not shown). The hot products of combustion expand to supersonic velocity through the expanding portion 18 of a venturi type nozzle indicated generally at 16 after passing through throat 17. The supersonic flow resulting and indicated generally at 20 is in the form of a long, columnar jet. The nature of the internal burner 10 and its operation is identical to that of U.S. Pat. No. 4,416,421, referred to previously.

The one exception is the fact that nozzle 17 is not coaxial with the combustion chamber, but in this case and preferably so is positioned within end wall 3 at the top of the combustion chamber 11 to facilitate the introduction of a wire rod 21 into the flame jet 20 to facilitate flame spray of fine droplets of the wire rod material onto a substrate 28 downstream of the exit 19 of nozzle 16 and positioned in the path of the flame jet 20. The internal burner 10 is provided with an inclined, elongated bore or hole 23 which functions as a wire rod guide passage through which wire 21 is fed by paired feed rolls 22. Rolls 22 grip the wire rod and move it in the direction of the gas stream 20 by rotation of the feed rolls 22 (by means not shown) in the direction of the arrows 7. As such, wire 21 meets the flame jet 20 immediately beyond the exit 19 of nozzle 16. If the wire 21 is sufficiently thin, upon being heated it bends (due to jet imposed forces) such that the tip 25 of the wire bends to align the tip along the axis of the flame jet 20. Such bending is initiated at point 24 of the wire 21. The tip 25 lies axially along jet 20 as though wire 21 had been itself introduced axially in the manner of U.S. Pat. No. 4,416,421.

For reasons to be discussed hereinafter, this axial relationship between the wire and the flame jet produces the finest suspension of particles 26 of the material forming the wire 21 within the flame jet stream which when striking the workpiece or substrate 28 forms a dense coating 27.

Unfortunately, the thinner the wire, the greater the cost per unit weight of metal. Thicker wire can be sent by flame jet forces if the wire is heated to a red heat prior to introduction to the high velocity flame. In that respect, while conventionally internal burners include cooling passages through which a coolant such as water is circulated to prevent overheating of the internal burner, limited to area of wire rod passage 23, such cooling means can be eliminated, and heating of the wire rod 21 can be effected as a preheating step by the simple passage of the wire through the bore or hole 23 in the vicinity of the hot combustion gases which exit from the nozzle 16 and directly impinge upon the wire as it leaves passage 23. By preheating the wire to a red heat, added spray rates result. Such heating may alternatively use any of the common heating methods including oxy-fuel flame, electric arcs or trasferred plasma arcs, resistance heating or even radio-frequency heating prior to introduction of the wire 21 into the wire guide or feed passage 23.

As another aspect of the present invention, and as illustrated in FIG. 2, where a larger diameter wire is employed and in which the wire is of significantly reduced flexibility, it has been determined that if the angle of inclination theta ($\theta$) relative to the axis of the flame jet is held below a certain critical value, the equivalent coating to coating 27 results, even in the absence of sufficient bending of the wire, to line up the tip in the flame jet direction as per FIG. 1.

In FIG. 2, the thicker wire 30 is fed into the flame jet 20 through the same passage 23 and at substantially the same angle theta ($\theta$) as that shown in FIG. 1. If the angle $\theta$ is smaller than $\theta_{cr}$, the droplet spray pattern 33 resembles that of spray pattern 26, FIG. 1, in every way. Wire 30 melts in such a manner that a nearly flat, eliptical surface 31 forms on the bottom face of the wire rearwardly of tip 32. The metal, when melted, forms a thin molten film which passes towards the tip 32. This film forms completely around the wire including the flat face 31. The film is forced into annular waves by the shear forces of the flame jet 20. These waves reach tip 32 where they are drawn into ligaments which in turn are atomized into very fine droplets of the wire rod material which disperse evenly within the flow stream of the flame jet 20 prior to impingement upon the workpiece or substrate.

FIG. 3*a*, which is an enlarged view of a typical wire rod tip within the flame spray, 20 shows only the tip portion of a wire such as wire 21 and 30, FIGS. 1 and 2. In this case the tip 43 of the wire 40 is shown as being axially aligned with the flame stream 20 and being surrounded by the same. At point 41 along the surface of the tip of the wire, the surface of the wire has been heated sufficiently to cause melting. The molten metal is forced by shearing action of the jet 20 gases to form a moving liquid film 42 passing towards the tip 43. In the portion shown in cross-hatching, the dash lines 47 define the outer boundary of non-molten metal content of the wire or wire rod 40. Film 42 (shown thicker than actual for emphasis) becomes unstable, forming waves 44 which rapidly move towards the tip 43. As the waves 44 separate from tip 43, ligaments 45 are first formed, that is, elongated or lineal suspensions of liquid material. These, in turn, are broken up by gas shear forces to form a fine suspension of molten droplets 46.

It is believed that optimum atomization (defined as producing the finest suspension of liquid particles or droplets) for the situation illustrated in FIG. 3*a*, occurs when waves 44 are symmetrically arrayed about the wire rod 40. Ligaments 45 are then of about the same thickeness.

Turning next to FIG. 3*b*, this illustrates the case where the wire rod 50 is introduced to the flame jet 20 at an angle $\theta$ which is greater than $\theta_{cr}$. A relatively flat face 51 is again produced, ending at tip 52. In this case, however the waves 54 only form on the upstream side of the wire, mostly on flat surface 51. When these waves reach tip 52, they fold over to the downstream side of wire 50 in the "shaddow" zone 53, not subject to high gas shear. Large drops 55 of liquid form and periodically separate from the wire. Even though they may break up into smaller particles 56, they never produce as fine a suspension as the more symmetric situation where the wire rod is alilgned with or nearly aligned with the flow stream as evidenced in FIGS. 1, 2 and 3*a*. The spray is course, is not nearly so concentrated, and the coating quality suffers badly. The physical phenomena illustrated in FIG. 3*a* occurs both in the FIG. 2 rigid wire case as well as in the flexible wire case of FIG. 1 (where the wire rod is relatively small diameter).

In FIG. 2, the optimum spray 33 results under conditions where the molten film envelopes 360 degrees around the wire 30 prior to reaching tip 32 in the manner shown in FIG. 3*a*. At some greater angle $\theta$ (larger than $\theta_{cr}$) such as 25 degrees, this no longer occurs. As may be appreciated, the invention provides a critical wire angle to the flame spray axis by which the hot gas flows smoothly over all portions of the wire. The liquid film is symmetrically spread over the entire circumference of the wire prior to reaching the tip. Larger angles produce improper gas flow on the downstream side of the wire leading to poor atomization and inferior quality of the resulting coating. The invention is equally applicable for use with burners operating on oxygen, air or mixtures of these oxidizers, and the invention has application where the flame spray apparatus is other than the internal burner type as shown in U.S. Pat. No. 4,416,421.

Additionally, the drawings illustrate the situation where the wire rod is introduced at the exit of the internal burner nozzle. It is, of course, possible to provide an asymmetric passage of the wire into the flame gases upstream of the nozzle exit as, for instance, just downstream of the throat 17 in the embodiment of FIGS. 1 and 2.

While the invention has been particularly shown and described with reference to a preferred embodiment thereof, it will be understood by those skilled in the art that various changes in form and details may be made therein without departing from the spirti and scope of the invention.

What is claimed is:

1. In a flame spray method comprising the steps of:

continuously combusting, under pressure, a continuous flow of an oxy-fuel mixture confined within an essentially closed internal burner combustion chamber, discharging the hot combustion product gases from the combustion chamber through a flow expansion nozzle as a high velocity hot gas stream flame jet, and feeding material to the stream for high temperature heat softening or liquefaction, spraying at high velocity onto a surface positioned in the path of the stream at the discharge end of the nozzle and spaced downstream therefrom, the improvement wherein the step of feeding said material comprises feeding said material in solid rod form, outside of said combustion chamber asymmetrically and continuously into said flame jet at an angle to said flame jet and at a point downstream of the exit from the flow expansion nozzle with said introduction angle of the rod relative to the flame jet axis and the rod diameter being such that the rod bends within the flame jet to line up the rod tip with the flame jet axis;

whereby, a liquid film develops about the periphery of the rod within the flame jet as a full symmetric circumferential coating about the unmelted portion of the rod within the flame jet, and the flame jet produces a very fine suspension of particles of the material forming the rod within the flame jet stream.

2. The flame spray method as claimed in claim 1, further comprising heating of said rod prior to its asymmetric introduction into the high velocity flame jet to a degree sufficient to produce a lower bending strength within said rod such that the force of the high velocity flame jet bends the rod to align the tip of the rod with the flame jet.

3. The flame spray method as claimed in claim 1, wherein said introduction angle is less than 25 degrees.

* * * * *